US007147210B2

(12) United States Patent
Foege et al.

(10) Patent No.: US 7,147,210 B2
(45) Date of Patent: Dec. 12, 2006

(54) CABLE TENSIONING SYSTEM AND METHOD OF OPERATION

(75) Inventors: Carl A. Foege, Watertown, WI (US); Edward T. Arters, Beaver Dam, WI (US); Roger R. Pili, Madison, WI (US)

(73) Assignee: Actuant Corporation, Milwaukee, WI (US)

( * ) Notice: Subject to any disclaimer, the term of this patent is extended or adjusted under 35 U.S.C. 154(b) by 209 days.

(21) Appl. No.: 10/770,167

(22) Filed: Feb. 2, 2004

(65) Prior Publication Data

US 2005/0177992 A1 Aug. 18, 2005

(51) Int. Cl.
*E21B 19/00* (2006.01)

(52) U.S. Cl. ..... 254/29 A; 254/93 H

(58) Field of Classification Search ..... 254/29 A, 254/93 L, 29 R, 93 H, 89 H
See application file for complete search history.

(56) References Cited

U.S. PATENT DOCUMENTS

| | | | | |
|---|---|---|---|---|
| 3,399,865 | A | 9/1968 | Kelly | |
| 3,554,492 | A | 1/1971 | Beghi | |
| 3,595,264 | A | 7/1971 | Martin | |
| 3,692,277 | A * | 9/1972 | Schwartz et al. | 254/29 A |
| 3,886,848 | A | 6/1975 | Budecker et al. | |
| 4,053,974 | A | 10/1977 | Howlett et al. | |
| 4,106,752 | A | 8/1978 | Roqueta | |
| 4,376,527 | A | 3/1983 | Ludvigson | |
| 4,405,114 | A | 9/1983 | Macchi | |
| 4,429,529 | A | 2/1984 | Sonneborn | |
| 4,471,805 | A | 9/1984 | Solie et al. | |
| 4,598,897 | A * | 7/1986 | Aikioniemi | 254/29 A |
| 4,716,933 | A | 1/1988 | Stoever et al. | |
| 4,959,957 | A | 10/1990 | Schmale et al. | |
| 4,964,433 | A | 10/1990 | Marietta | |
| 4,998,453 | A * | 3/1991 | Walton et al. | 81/57.38 |
| 5,328,147 | A | 7/1994 | Stobbs | |
| 5,482,085 | A | 1/1996 | Wasson | |
| 6,224,036 | B1 * | 5/2001 | Prince et al. | 254/29 A |
| 6,296,015 | B1 | 10/2001 | Morisako et al. | |

FOREIGN PATENT DOCUMENTS

| | | |
|---|---|---|
| DE | 15 59 093 A1 | 9/1969 |
| DE | 20 40 545 A1 | 2/1972 |

* cited by examiner

*Primary Examiner*—Lee D. Wilson
(74) *Attorney, Agent, or Firm*—Quarles & Brady LLP

(57) ABSTRACT

A concrete reinforcement cable tensioning system is variably adjustable to apply different crimping for different sized cables. The system includes a concrete reinforcement cable tensioner having a first actuator for tensioning a cable extending through a concrete structure and a second actuator for crimping a grommet onto the cable. A first hydraulic line is in fluid communication with the first actuator and selectively provides pressurized hydraulic fluid to the first actuator. A second hydraulic line is in fluid communication with the second actuator and selectively provides pressurized hydraulic fluid to the second actuator. A normally closed pilot operated sequencing valve is disposed in the first hydraulic line, and has a pilot line in fluid communication with the second hydraulic line for sensing a pressure in the second hydraulic line, wherein the sequencing valve opens to exhaust hydraulic fluid from the first actuator upon the pressure in the second hydraulic line reaching a predetermined pressure. The predetermined pressure is variably changeable to accommodate different pressures required to crimp grommets on different sizes of cable.

20 Claims, 9 Drawing Sheets

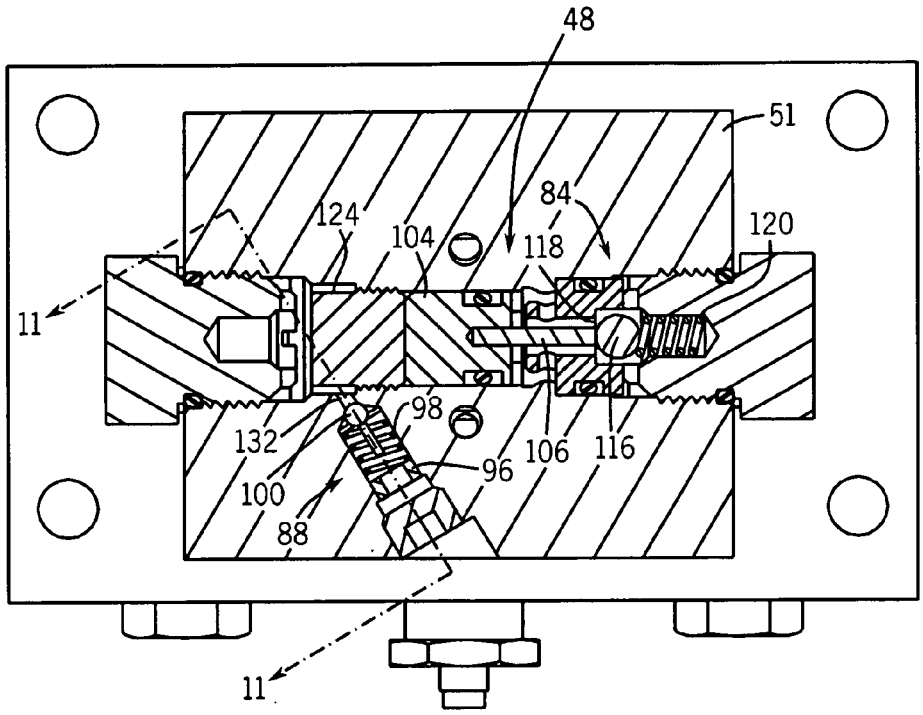
FIG. 10
FIG. 11
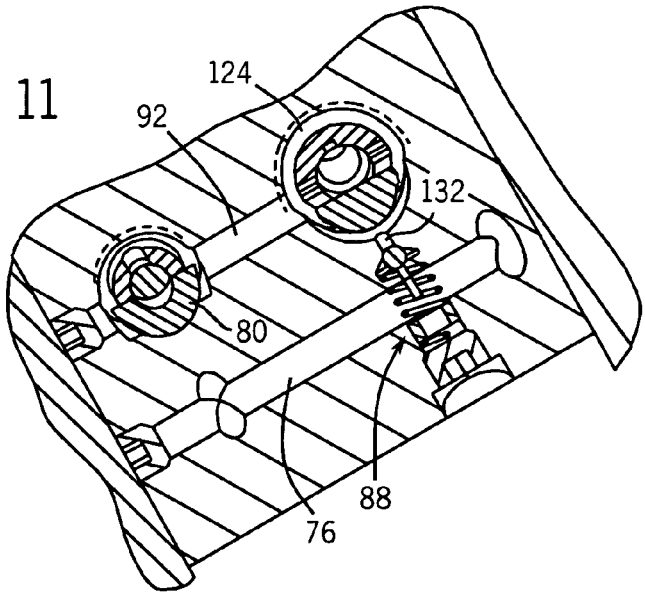

CABLE TENSIONING SYSTEM AND METHOD OF OPERATION

CROSS REFERENCES TO RELATED APPLICATIONS

Not Applicable

STATEMENT REGARDING FEDERALLY SPONSORED RESEARCH

Not Applicable

BACKGROUND OF THE INVENTION

The field of invention is cable tensioning systems, and more particularly, a method and system for tensioning cables for concrete reinforcement.

Concrete reinforcement cable tensioning systems are used to form prestressed concrete structures, such as concrete floors, beams, and the like, that are reinforced with braided wire cables. To form the prestressed concrete structures, concrete is poured into a form having one or more of the cables laid therein, such that the cables extend through the concrete from one side of the structure to another side. After the concrete has partially cured, one end of each cable is secured to one side of the structure, and the other end of each cable is grasped by a concrete reinforcement cable tensioner which pulls on the cable to tension the cable and exert a compressive force on the concrete structure.

Concrete reinforcement cable tensioners known in the art typically have at least one hydraulic tensioning cylinder with a gripping mechanism fixed to the cylinder for grasping the cable, a crimping hydraulic cylinder that crimps a grommet onto the cable, and a housing, or frame, secured to the piston rods of the cylinders for bearing (directly or indirectly) against the side edge of the concrete slab so that a tension of a high magnitude can be exerted on the cable. A seat which mates with the grommet is typically cast into the side edge of the concrete where the cable comes out and the cable extends through the seat and through the grommet in the seat which only permits one way movement of the cable through the grommet.

Once the cable is tensioned, the crimping cylinder urges the grommet into the seat to crimp the grommet, such that the grommet engages the cable and tightens around it to prevent reverse movement and consequent reduction in the tensile force on the cable. Tensioning devices for performing this operation, seats and grommets are all well known. One exemplary concrete reinforcement cable tensioner is disclosed in U.S. Pat. No. 6,224,036 which is fully incorporated herein by reference and assigned to the assignee of the present invention.

A concrete reinforcement cable tensioner typically forms part of a concrete reinforcement cable tensioning system which includes a hydraulic unit that supplies hydraulic fluid to the hydraulic cylinders of the tensioner. The hydraulic unit typically includes a three position, four way manually operable hydraulic valve. The valve has a tensioning position which directs hydraulic fluid into the tensioning hydraulic cylinder to tension the cable, a hold position that maintains a constant tension on the cable, and a crimping position that directs hydraulic fluid into the crimping hydraulic cylinder to crimp the grommet onto the cable. A sequencing valve in the hydraulic unit releases tension on the cable by allowing hydraulic fluid to exhaust from the tensioning cylinder once the grommet has been crimped onto the cable.

In a known concrete reinforcement cable tensioning system, the sequencing valve exhausts hydraulic fluid from the tensioning hydraulic cylinder once the pressure in the crimping cylinder reaches a predetermined pressure. The predetermined pressure, however, is fixed regardless of the size of the cable being tensioned. If the diameter of the cable is large compared to the nominal cable diameter around which the concrete reinforcement cable tensioner was designed, the sequencing valve could release the tension in the cable before the grommet is securely crimped onto the cable.

If an improper crimping pressure is used, the cable can slip through the grommet and relieve the compressive force on the concrete structure, which provides a weaker concrete structure than intended. Likewise, if the diameter of the cable is small compared to the nominal cable diameter around which the concrete reinforcement cable tensioner was designed, the sequencing valve could fail to release the tension in the cable until long after the grommet is securely crimped onto the cable. As a result, the operation may result in too much tension in the cable, a damaged cable, or an operation that takes longer than is required which unnecessarily increases the cost of the operation.

BRIEF SUMMARY OF THE INVENTION

The present invention provides a concrete reinforcement cable tensioning system that is variably adjustable to apply different crimping pressures for different sized cables. The system includes a concrete reinforcement cable tensioner having a first actuator for tensioning a cable extending through a concrete structure and a second actuator for crimping a grommet onto the cable. A first hydraulic line is in fluid communication with the first actuator and selectively provides pressurized hydraulic fluid to the first actuator. A second hydraulic line is in fluid communication with the second actuator and selectively provides pressurized hydraulic fluid to the second actuator. A normally closed pilot operated sequencing valve is disposed in the first hydraulic line, and has a pilot line in fluid communication with the second hydraulic line for sensing a pressure in the second hydraulic line, wherein the sequencing valve opens to exhaust hydraulic fluid from the first actuator upon the pressure in the second hydraulic line reaching a predetermined pressure. The sequencing valve is variably adjustable to open in response to different predetermined pressures in order to provide different pressures necessary to crimp different grommets on different sized cables. In one embodiment, a relief valve disposed in a supply line supplying hydraulic fluid to the first hydraulic actuator is variably adjustable to open upon reaching a desired pressure in the first hydraulic actuator corresponding to a desired tension in the cable.

A general objective of the present invention is to provide a concrete reinforcement cable tensioning system that is variably adjustable to apply different crimping for different sized cables. This objective is accomplished by providing a valve that is variably adjustable to provide a variably adjustable crimping pressure selected by the user for a particular sized cable.

The foregoing and other objectives and advantages of the invention will appear from the following description. In the description, reference is made to the accompanying drawings which form a part hereof, and in which there is shown by way of illustration a preferred embodiment of the invention.

BRIEF DESCRIPTION OF THE DRAWINGS

FIG. 10 is a sectional view of the flow control valve assembly along line 10—10 of FIG. 7; and FIG. 11 is a sectional view of the flow control valve assembly along line 11—11 of FIG. 10.

DETAILED DESCRIPTION OF THE PREFERRED EMBODIMENTS

Figure 1:
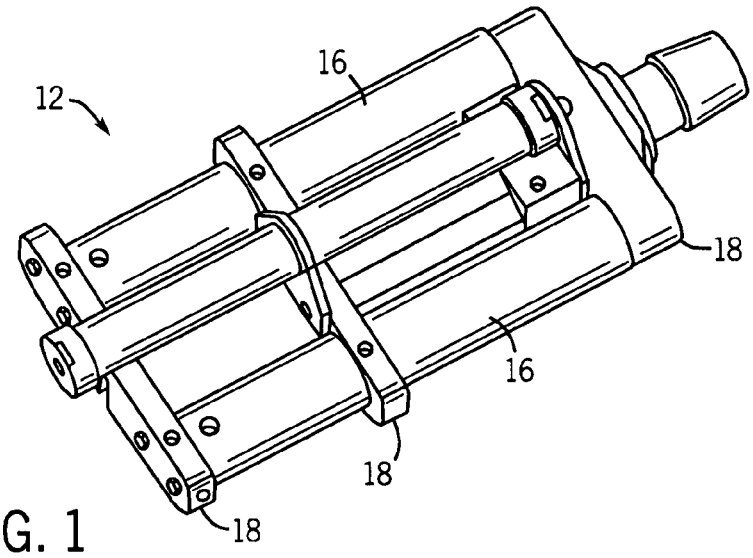
FIG. 1 is a top perspective view of a retracted cable tensioner for use in a cable tensioning system incorporating the present invention.
Figure 2:
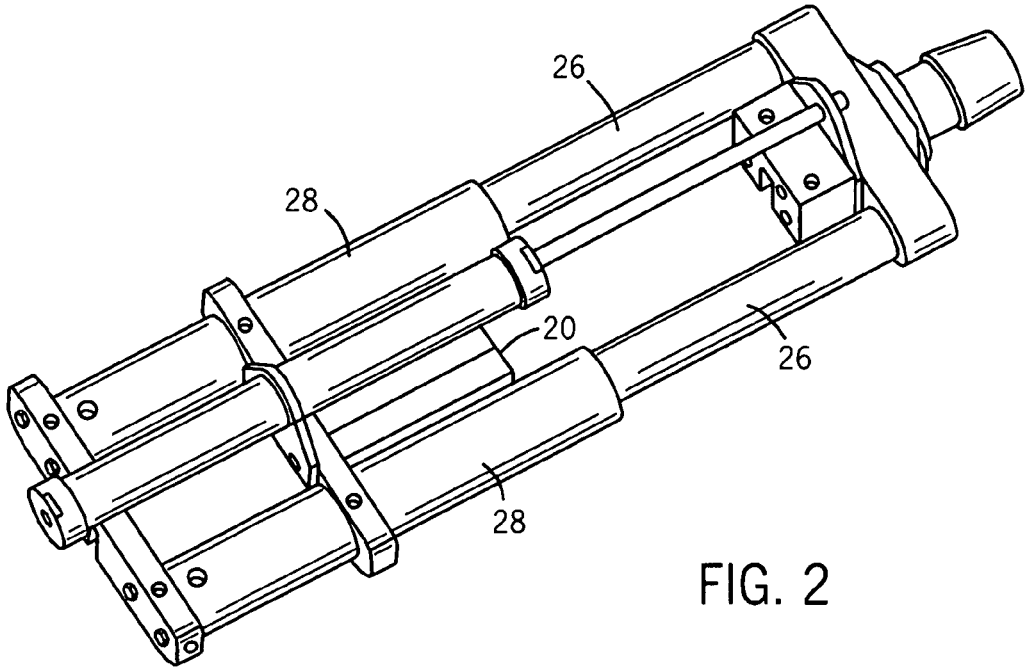
FIG. 2 is a top perspective view of the cable tensioner of FIG. 1 in an extended position.
Figure 3:
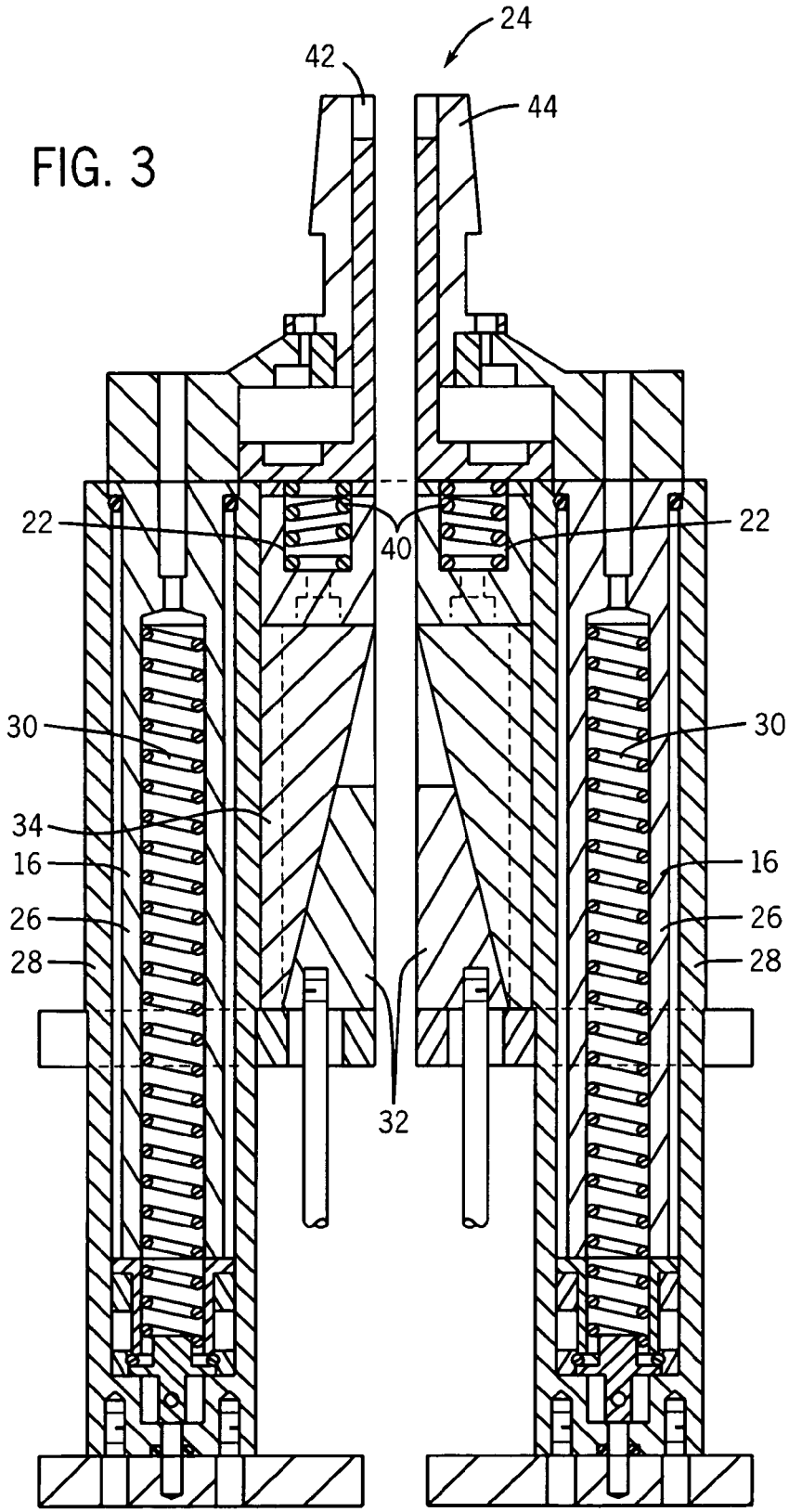
FIG. 3 is a top sectional view of the cable tensioner of FIG. 1.

As shown in FIGS. 1–3, a concrete reinforcement cable tensioning system 10 includes a cable tensioner 12 and a power unit 14. The cable tensioner 12, such as disclosed in U.S. Pat. No. 6,224,036 and which is fully incorporated herein by reference, is known in the art, and tensions a cable extending through a concrete structure to prestress the concrete structure. The tension in the cable is maintained by a grommet crimped onto the cable and received in a seat formed in the concrete structure. The power unit 14 provides pressurized hydraulic fluid to the cable tensioner 12 to tension the cable and crimp the grommet thereon.

The cable tensioner 12 includes a pair of single acting tensioning actuators 16 mounted in a frame 18. The tensioning actuators 16 urge a gripper 20 engaging the cable from a retracted position toward an extended position to tension the cable. A pair of single acting crimping actuators 22 urge a crimper 24 from a retracted position toward an extended position to crimp a grommet onto the tensioned cable and maintain the tension in the cable. Although pairs of tensioning and crimping actuators 16, 22 are disclosed, the cable tensioner can include one or more tensioning actuators and one or more crimping actuators without departing from the scope of the invention.

In the embodiment disclosed herein, the tensioning actuators 16 are conventional single acting actuators having a rod 26 slidably received in a cylinder 28. The rod 26 of each actuator 16 is hollow (i.e. tubular) which houses an extension spring 30 having one end fixed to the rod 26 and the other end fixed to the cylinder 28. The extension spring 30 biases the rod toward the retracted position against the force of hydraulic fluid supplied by the power unit 14 and disposed in the cylinder 28.

The gripper 20 of generally conventional design includes a gripper housing 34 of the general shape shown in FIGS. 1–3 and wedge shaped gripper jaws 32 which slide on angled surfaces within the gripper housing 34. The gripper jaws 32 engage the cable, and are urged toward an extended position by the tensioning actuators 16 to tension the cable.

The crimper 24 extends forwardly from the cable tensioner frame 18, and includes a crimper nose 42 that is slidably received in a crimper housing 44. The crimper nose 42 is urged from a retracted position inside the crimper housing 44 toward an extended position by the crimping actuators 22. When the cable is pulled through the grommet by the cable tensioner 12, the grommet permits the cable to slide relative to it so that the cable can be tensioned. However, when crimping, the crimper nose 42 urges the grommet into a conical seat formed in the concrete structure which crimps the grommet into an engaged position in which the grommet bites into the cable and holds the cable under tension. Springs 40 disposed in the crimping actuators 22 return the crimper nose 42 to the retracted position upon hydraulic fluid exhausting from the crimping actuators 22.

Figure 4:
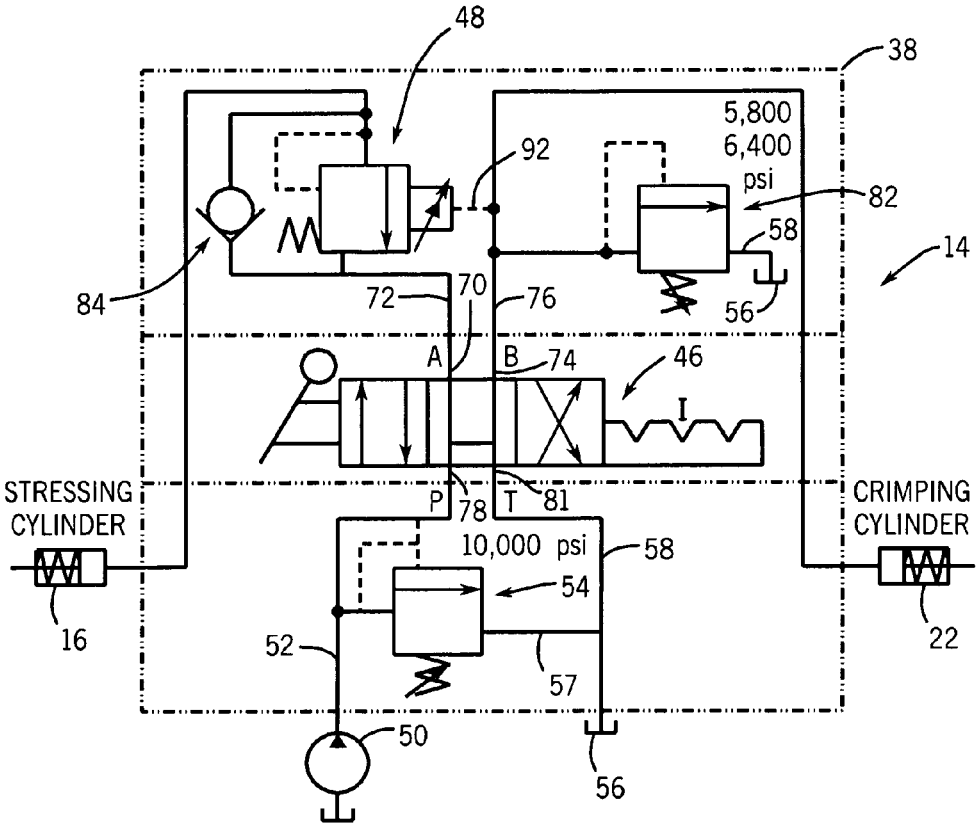
FIG. 4 is a hydraulic schematic of a cable tensioning system incorporating the present invention.
Figure 5:
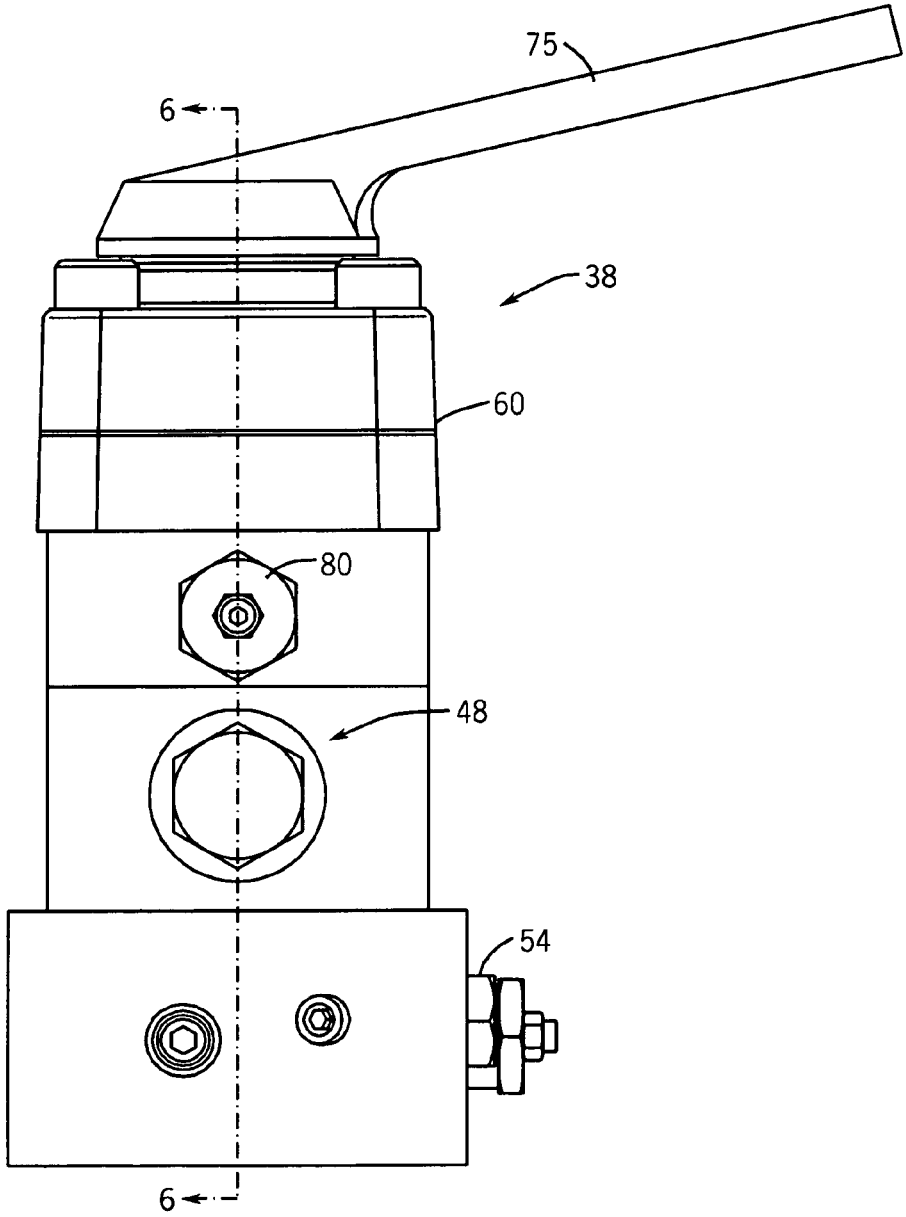
FIG. 5 is a side view of a flow control valve assembly forming part of the cable tensioning system of FIG. 4.
Figure 6:
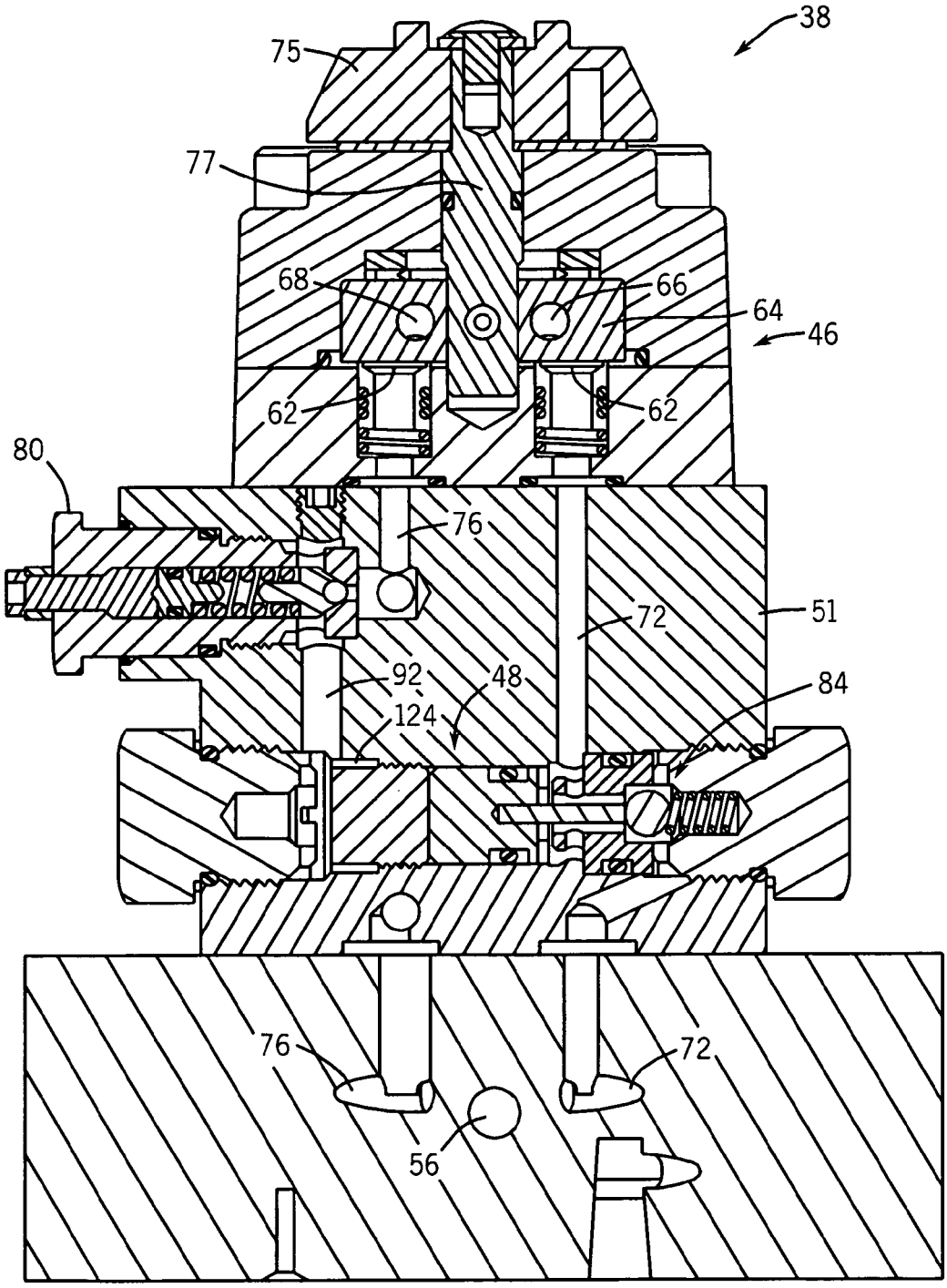
FIG. 6 is a sectional view of the flow control valve assembly along line 6—6 of FIG. 5.
Figure 7:
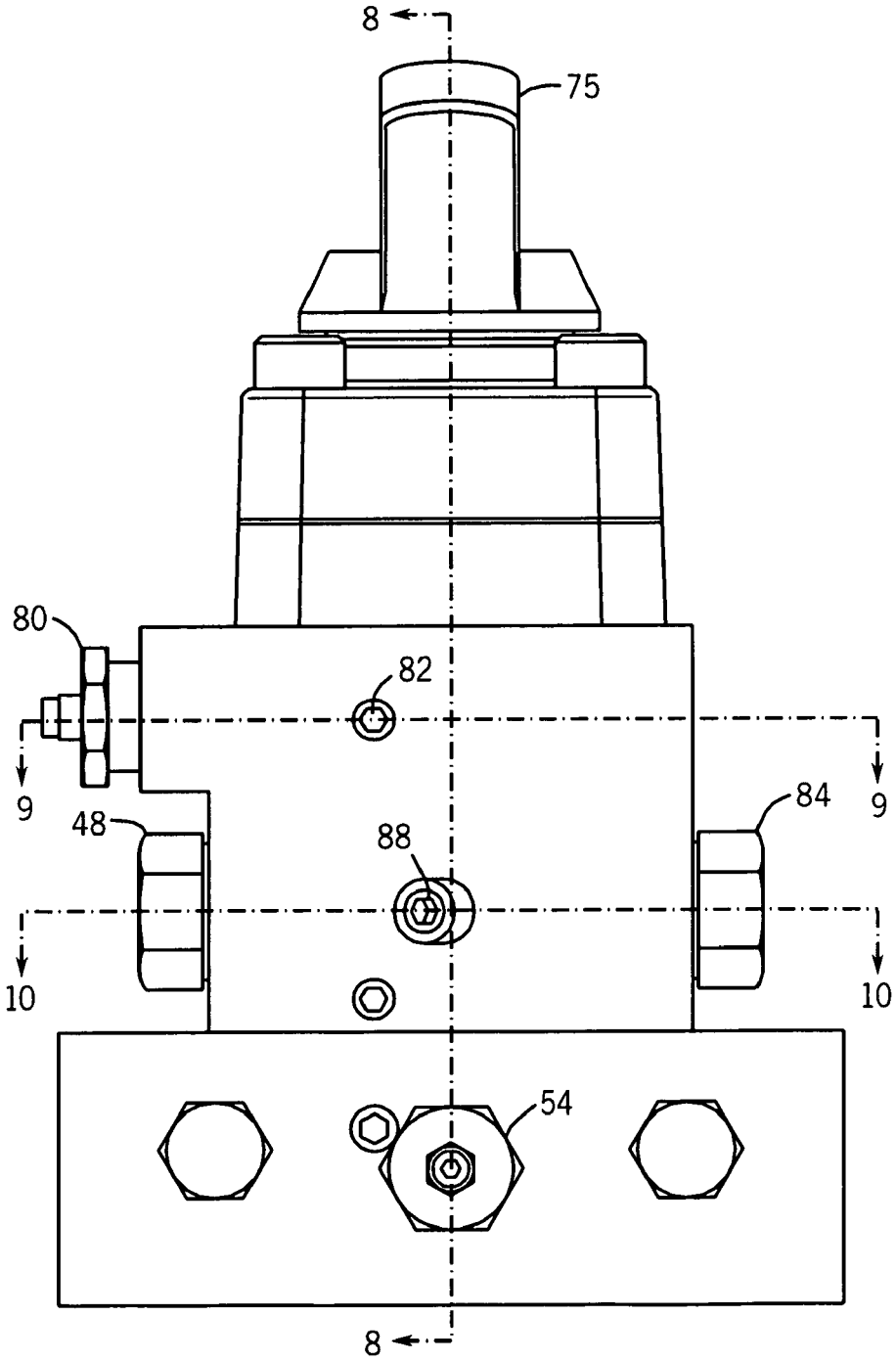
FIG. 7 a front view of a flow control valve assembly forming part of the cable tensioning system if FIG. 4.
Figure 8:
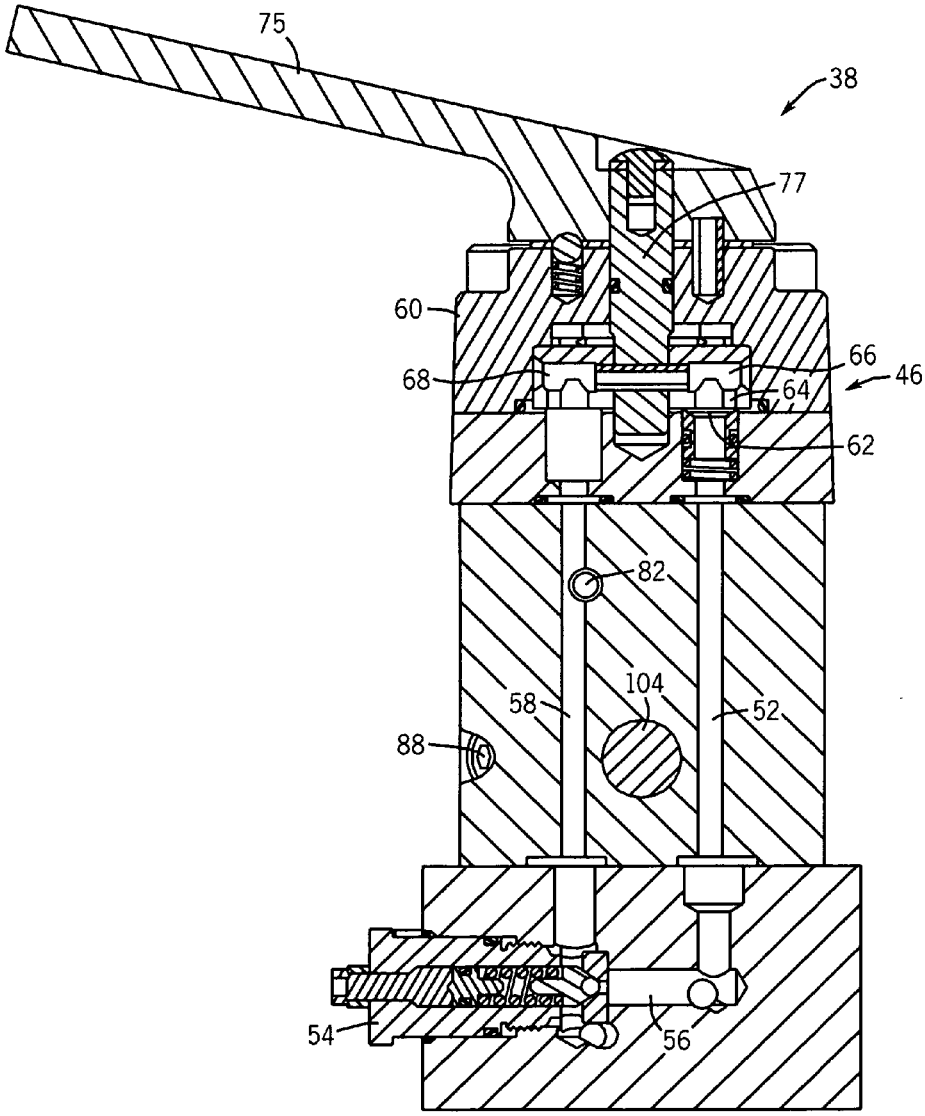
FIG. 8 is a sectional view of the flow control valve assembly along line 8—8 of FIG. 7.
Figure 9:
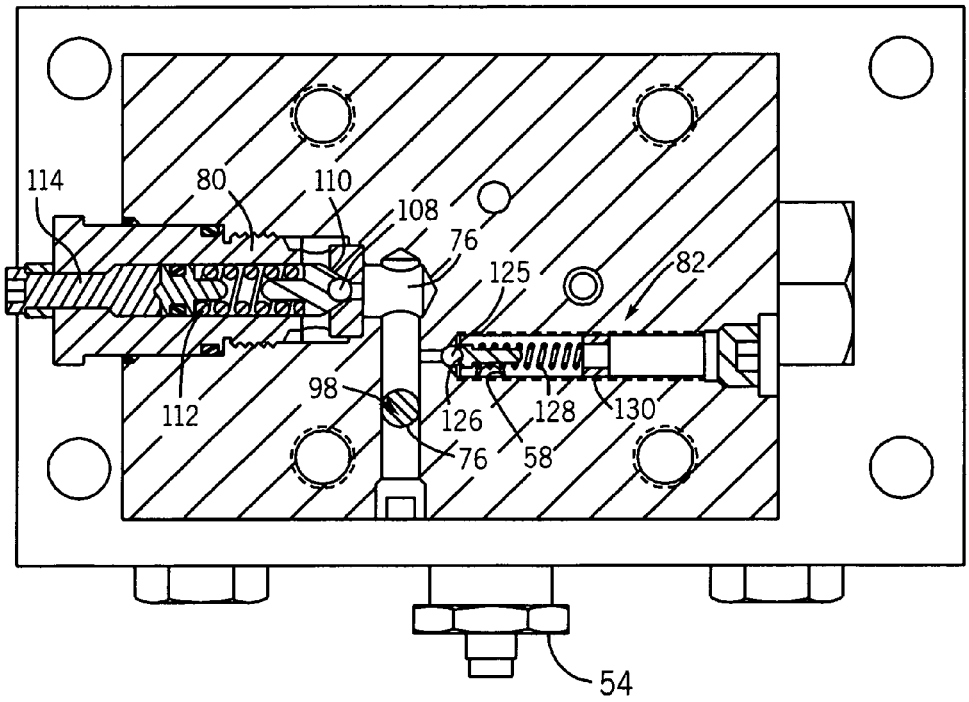
FIG. 9 is a sectional view of the flow control valve assembly along line 9—9 of FIG. 7.

As shown in FIG. 4, the cable tensioning system actuators 16, 22 are powered by the power unit 14 which provides pressurized hydraulic fluid to the cable tensioner 12. The power unit 14 includes a flow control valve assembly 38 that controls the flow of hydraulic fluid to and from the cable tensioner 12. The flow control valve assembly 38 includes a flow control valve 46 that controls the flow of hydraulic fluid to tension the cable and crimp the grommet thereon and a sequencing valve 48 that controls hydraulic fluid exhausting from the tensioning actuators 16 to ensure the grommet is crimped prior to releasing the cable from the jaws 32. Advantageously, the sequencing valve 48 is operable by a pilot pressure, and is variably adjustable to retract the tensioning actuators 16 upon reaching different predetermined pressures in the crimping hydraulic line 76 in order accommodate cables having different diameters.

As shown in the hydraulic circuit schematic shown in FIG. 4, the power unit 14 also includes a hydraulic pump 50 that supplies pressurized hydraulic fluid through the flow control valve 46 to the actuators 16, 22. The pump 50 supplies pressurized hydraulic fluid to the flow control valve 46 through a hydraulic supply line 52, or passageway.

A user adjustable relief valve 54 disposed in a short circuit line 57 is provided that can short circuit the supply line 52 to an exhaust line 58 when the pressure in the supply line 52, and thus the actuator 16, 22 being supplied with hydraulic fluid from the supply line 52, reaches a predetermined level. Advantageously, the user adjustable relief valve 54 can form part of the flow control valve assembly 38, and can be variably adjusted by the user to open and relieve pressure in the supply line 52, and thus cease applying more tension on the cable, at different pressures depending upon the tension desired in the cable being tensioned. As a result, the user adjustable relief valve 54 can be adjusted such that the cable tensioning actuators 16 cease applying tension to a cable corresponding to the desired tension in a cable for a particular cable size. The exhaust line 58 exhausts the hydraulic fluid into a reservoir 56. In a preferred embodiment, the user adjustable relief valve has a maximum relief pressure of about 10,000 psi.

Preferably, as shown in FIGS. 5–11, the flow control valve 46 is a four way, three position, valve that includes a housing 60 which houses shear valves 62 and a rotatable disc 64. The disc 64 includes two passageways 66, 68 having a pair of openings, each opening aligns with openings in the housing 60 in either of the three positions. By rotating the disc 64, the four openings in the disc 64 align with the four corresponding openings in the housing 60 that correspond to A outlet 70 which is in fluid communication with the tensioning actuators 16 through a tensioning hydraulic line 72, B outlet 74 which is in fluid communication with the crimping actuators 22 through a crimping hydraulic line 76, P inlet 78 which is in fluid communication with the pump 50 through the supply line 52, and T return 81 which is in fluid communication with the reservoir 56 through the exhaust line 58. A handle 75 fixed to the disc 64 by a shaft 77 rotates the disc 64 relative to the housing 60 to selectively move the disc 64 into one of three positions.

A check valve 84 disposed in the tensioning hydraulic line 72 includes a ball 116 urged into a seat 118 by a spring 120. The check valve 84 allows fluid flow in one direction toward the tensioning actuators 16 to extend the tensioning actuators 16 while preventing fluid flow in the opposite direction. The check valve 84 is integrated with the sequencing valve 48 which opens the check valve 84 in response to the pressure in the crimping hydraulic line 76 to retract the tensioning actuators 16.

The normally closed, pilot operated sequencing valve 48 opens to exhaust hydraulic fluid out of the tensioning actuators 16 by opening the check valve 84 once the pressure in the crimping hydraulic line 76 has reached a predetermined pilot pressure. The sequencing valve 48 is variably adjustable independently of the pressure in the crimping hydraulic line 76 to open in response to different predetermined pressures in the crimping hydraulic line 76. Advantageously, by providing a variably adjustable sequencing valve, different sized cables that require different pressures in the crimping hydraulic line 76 to properly crimp the grommet onto the cable before the tensioning actuators 16 are retracted can be accommodated. Although a sequencing valve 48 integrated with the check valve 84 is disclosed, the sequencing valve can be independent of the check valve 84, such as shown in FIG. 3, and provide a hydraulic flow path around the check valve 84 to exhaust hydraulic fluid from the tensioning actuators 16 without departing from the scope of the invention.

The sequencing valve 48 includes a piston 104 slidably received in a cavity 124 formed in a valve block 51. The piston engages a pin 106 that acts on the check valve 84 to lift the check ball 116 out of the seat 118 to exhaust hydraulic fluid from the tensioning actuators 16. The check valve 84 and the sequencing valve 48 cooperatively either allow fluid flow and pressure through the tensioning hydraulic line 72, hold pressure in the tensioning actuators 16, or allow fluid flow to exhaust from the tensioning actuators 16 through the sequencing valve 48.

In the preferred embodiment, the sequencing valve 48 is variably adjustable using a sequencing relief valve 80 that controls the flow of hydraulic fluid through a pilot line 92 in fluid communication with the crimping hydraulic line 76 and sequencing valve cavity 124. The sequencing relief valve 80 blocks hydraulic fluid flow through a pilot line 92 until a predetermined pressure is attained in the crimping hydraulic line 76. Once the predetermined pressure has been reached, the sequencing relief valve 80 allows a small amount of pressurized fluid through the pilot line 92 into the sequencing valve cavity 124 to urge the piston 104 toward the check valve 84 and open the check valve 84. This then allows hydraulic fluid to exhaust from the tensioning actuators 16 through the tensioning hydraulic line 72 and check valve 84 thereby allowing the tensioning actuators 16 to retract.

The sequencing relief valve 80 includes a ball 108 urged into a valve seat 110 by a spring 112. The ball 108 blocks the flow of hydraulic fluid from the crimping hydraulic line 76 into the sequencing valve cavity 124 until the pressure in the crimping hydraulic line 76 exceeds the force exerted on the ball 108 by the spring 112. The force exerted by the spring 112 on the ball 108 is variably adjusted by a screw 114 engaging the spring 112. Preferably, the force exerted on the ball 108 by the spring 112 of sequencing relief valve 80 is sufficiently adjustable such that the sequencing valve 48 opens the check valve 84 when the predetermined pilot pressure is between about 200 and 10,000 psi in order to tension and crimp a wide range of cables.

A cavity relief valve 88 relieves pressure in the cavity 124 through a relief line 132 once pressure has been reduced in the crimping hydraulic line 76 below a predetermined pressure. In the embodiment disclosed herein, the variably adjustable cavity relief valve 88 is adjustable by a user using an Allen wrench, screw driver, or other tool, that engages a screw 96 to alter a force exerted by a spring 98 onto a ball 100. The relief line 132 is in fluid communication with the crimping hydraulic line 76 downstream of the ball 100. As a result, the pressure in the cavity 124 must be greater than the force exerted on the ball 100 by the spring 98 and the pressure in the crimping hydraulic line 76 before the cavity relief valve 88 opens.

A user adjustable crimping relief valve 82 is in fluid communication with the crimping hydraulic line 76, and exhausts to the reservoir 56 through the exhaust line 58 once a predetermined pressure has been achieved in the crimping hydraulic line 76. The relief valve 82 includes a ball 125 urged into a seat 126 by a spring 128. A screw 130 engaging the spring 128 is axially movable by a user to adjust the force exerted by the spring 128 onto the ball 125.

Referring now to FIGS. 1–11, when extending the tensioning actuators 16 to tension the cable, the disc 64 of the flow control valve 46 is rotated to an advance position so that the disc passageways 66, 68 align P inlet to A outlet and B outlet to T return. The pump 50 is turned on and supplies fluid flow to the tensioner 12 through the flow control valve assembly 38 to extend the tensioning actuators 16 and tension the cable.

After attaining the limiting pressure of the user adjustable relief valve 54, the disc 64 is rotated to the neutral position which connects A, B, P, and T passageways together thereby reducing pressure. In this position, the pump 50 is turned off and no fluid flow is directed through the valve assembly 38.

In order to crimp the grommet onto the cable, the disc 64 is rotated to a retract position so that the P inlet is connected to the B outlet and A outlet is connected to T return. The pump 50 is turned on, and hydraulic fluid is pumped through the flow control valve assembly 38 into the crimping actuators 22 to crimp the grommet onto the cable. Tension is maintained in the cable by the tensioning actuators 16 which do not retract and release the cable until the sequencing valve 48 opens to allow hydraulic fluid to exhaust from the tensioning actuators 16 into the reservoir 56 through the fluid control valve assembly 38.

The sequencing valve 48 is normally closed to flow until a predetermined pressure is attained in the sequencing relief valve 80 which then inputs a small amount of pressurized fluid into the sequencing valve cavity 124 to move the piston 104 in the sequencing valve 48 and open the check valve 84 to allow hydraulic fluid to exhaust from the tensioning actuators 16 thereby allowing the tensioning actuators to retract.

Once the grommet is crimped onto the cable, the disc 64 is rotated back to the neutral position connecting all passageways 66, 68 to low pressure to retract the crimping actuators 22. In this position, the pump 50 is turned off, and the cavity relief valve 88 opens to relieve the pressure in the sequencing valve cavity 124. This then reduces the internal pressure in this cavity 124 and the piston of the sequencing valve 48 is allowed to return to its neutral position by means of the spring 120.

When a different sized cable is being tensioned, the user adjustable relief valve 54 and the sequence valve 48 are adjusted in order to provide the desired tension in the cable and the proper crimping pressure on the grommet, respectively. The pilot pressure of the sequencing valve 48 necessary to begin retracting the tensioning actuators 16 is changed by adjusting the force exerted by the spring 112 onto the ball 108 in the pilot line 92, by turning screw 114, such that the proper pressure is reached in the crimping hydraulic line 76, in order to properly crimp the grommet onto the different sized cable. Advantageously, the position of screw 114 for different cable diameters can be identified, for example, by identifying the number of turns out from being fully seated, for each nominal diameter that the tensioner may be used with. A table showing the number of turns that corresponds to a particular cable diameter, or range of diameters, can be provided as indicia fixed to the power unit, or in instructions accompanying the cable tensioning system.

While there have been shown and described what is at present considered the preferred embodiments of the invention, it will be obvious to those skilled in the art that various changes and modifications can be made therein without departing from the scope of the invention defined by the appended claims.

We claim:

1. A concrete reinforcement cable tensioning system, said system comprising:

a concrete reinforcement cable tensioner having a first actuator for tensioning a cable fixed relative to said first actuator and extending through a concrete structure, a gripper fixing said cable relative to said first actuator, and a second actuator for crimping a grommet onto said cable;

a first hydraulic line in fluid communication with said first actuator and selectively providing pressurized hydraulic fluid to said first actuator;

a second hydraulic line in fluid communication with said second actuator and selectively providing pressurized hydraulic fluid to said second actuator; and a normally closed pilot operated sequencing valve disposed in said first hydraulic line, and having a pilot line in fluid communication with said second hydraulic line for sensing a pressure in said second hydraulic line, wherein said sequencing valve opens to exhaust hydraulic fluid from said first actuator upon the pressure in said second hydraulic line reaching a predetermined pressure, and said predetermined pressure is variably changeable to accommodate different pressures required to crimp grommets on different sizes of cable.

2. The system as in claim 1, in which a bypass hydraulic line bypasses said sequencing valve to allow hydraulic fluid to bypass said sequencing valve when hydraulic fluid is being supplied to said first actuator to tension the cable, and a check valve disposed in said bypass hydraulic line prevents hydraulic fluid from exhausting from said first actuator through said bypass line.

3. The system as in claim 1, in which said sequencing valve forms part of a flow control valve assembly that selectively directs hydraulic fluid into at least one of said first actuator and said second actuator.

4. The system as in claim 1, in which said predetermined pressure is variably changeable independent of the pressure in said second hydraulic line.

5. The system as in claim 1, in which said sequencing valve includes a piston disposed in a chamber in fluid communication with said second hydraulic line via said pilot line, wherein said piston slidably moves in said chamber in response to pressure in said second hydraulic line to open said sequencing valve at said predetermined pressure.

6. The system as in claim 5, including a check valve blocking the flow of hydraulic fluid out of said first actuator through said first hydraulic line, and said piston acts on said check valve to allow hydraulic fluid to flow through said first hydraulic line out of said first actuator upon the pressure in said second hydraulic line reaching said predetermined pressure.

7. The system as in claim 1, in which a hydraulic supply line supplies pressurized hydraulic fluid to said first hydraulic line, and a user adjustable relief valve disposed in said hydraulic supply line is variably adjustable to open upon reaching a desired pressure corresponding to a desired tension in the cable.

8. A method of tensioning and crimping cables extending through at least one concrete structure, said method comprising:

gripping a first cable with a gripper forming part of a concrete reinforcement cable tensioning system to fix the cable relative to a first hydraulic actuator forming part of the concrete reinforcement cable tensioning system;

actuating the first hydraulic actuator to tension the first cable fixed relative to said first hydraulic actuator by pumping hydraulic fluid through a flow control valve assembly into said first hydraulic actuator;

actuating a second hydraulic actuator forming part of a concrete reinforcement cable tensioning system to crimp a grommet onto said first cable by pumping hydraulic fluid through said flow control valve assembly into said second hydraulic actuator;

exhausting hydraulic fluid from said first hydraulic actuator through said flow control assembly once pressure in said second hydraulic actuator reaches a first predetermined pressure;

adjusting said flow control valve assembly to exhaust hydraulic fluid from said first hydraulic actuator through said flow control valve assembly once pressure in said second hydraulic actuator reaches a second predetermined pressure, wherein said second predetermined pressure is different from said first predetermined pressure and corresponds to a desired crimping pressure for a second cable;

actuating said first hydraulic actuator to tension said second cable by pumping hydraulic fluid through said flow control valve assembly into said first hydraulic actuator;

actuating said second hydraulic actuator to crimp a grommet onto said second cable by pumping hydraulic fluid through said flow control valve assembly into said second hydraulic actuator; and exhausting hydraulic fluid from said first hydraulic actuator through said flow control assembly once pressure in said second hydraulic actuator reaches said second predetermined pressure.

9. The method of claim 8, in which said flow control valve assembly includes a first hydraulic line in fluid communication with said first actuator, a second hydraulic line in fluid communication with said second actuator, and a normally closed pilot operated sequencing valve disposed in said first hydraulic line, and having a pilot line in fluid communication with said second hydraulic line for sensing a pressure in said second hydraulic line, wherein said sequencing valve opens to exhaust hydraulic fluid from said first actuator upon the pressure in said second hydraulic line reaching one of said first and second predetermined pressure, and adjusting said flow control valve includes adjusting said sequencing valve to open at said second predetermined pressure.

10. The method as in claim 8, in which said flow control valve assembly includes a relief valve controlling the flow of hydraulic fluid into said first actuator, said relief valve being variably adjustable to open upon reaching a desired pressure, and adjusting said flow control valve assembly includes adjusting said flow control valve assembly to open said relief valve once pressure in said first actuator reaches the desired pressure corresponding to a desired tension in the second cable.

11. A concrete reinforcement cable tensioning system, said system comprising:

a concrete reinforcement cable tensioner having a first actuator for tensioning a cable fixed relative to said first actuator and extending through a concrete structure, a gripper fixing said cable relative to said first actuator, and a second actuator for crimping a grommet onto said cable;

a first hydraulic line in fluid communication with said first actuator and selectively providing pressurized hydraulic fluid to said first actuator;

a relief valve controlling the flow of hydraulic fluid into said first actuator through said first hydraulic line, said relief valve being variably adjustable to open upon reaching a desired pressure corresponding to a desired tension in the cable;

a second hydraulic line in fluid communication with said second actuator and selectively providing pressurized hydraulic fluid to said second actuator;

a piston disposed in a chamber in fluid communication with said second hydraulic line via a pilot line, wherein said piston slidably moves in said chamber in response to pressure in said second hydraulic line;

a check valve blocking the flow of hydraulic fluid out of said first actuator through said first hydraulic line, wherein said piston acts on said check valve to allow hydraulic fluid to flow through said first hydraulic line out of said first actuator upon the pressure in said second hydraulic line reaching a predetermined pressure; and a pilot line relief valve disposed in said pilot line and controlling the flow of fluid through said pilot line from said second hydraulic line into said chamber, wherein said pilot line relief valve is variably adjustable to change said predetermined pressure necessary to open said check valve to accommodate different pressures required to crimp grommets on different sizes of cable.

12. The system as in claim 11, in which said check valve forms part of a flow control valve assembly that selectively directs hydraulic fluid into at least one of said first actuator and said second actuator.

13. The system as in claim 11, in which said pilot line relief valve is variably changeable independent of the pressure in said second hydraulic line.

14. A hydraulic tensioning system comprising:

a hydraulic tensioning actuator for tensioning a cable fixed relative to said hydraulic tensioning actuator;

a gripper fixing said cable relative to said hydraulic tensioning actuator;

a hydraulic crimping actuator for crimping a grommet onto a cable tensioned by said hydraulic tensioning actuator; and a sequencing valve that maintains pressure in said hydraulic tensioning actuator until hydraulic pressure in said crimping actuator exceeds a certain threshold, and said threshold is adjustable to crimp grommets on different sizes of cable.

15. The system as in claim 14, in which a bypass hydraulic line bypasses said sequencing valve to allow hydraulic fluid to bypass said sequencing valve when hydraulic fluid is being supplied to said hydraulic tensioning actuator to tension the cable, and a check valve disposed in said bypass hydraulic line prevents hydraulic fluid from exhausting from said hydraulic tensioning actuator through said bypass line.

16. The system as in claim 14, in which said sequencing valve forms part of a flow control valve assembly that selectively directs hydraulic fluid into at least one of said first actuator and said second actuator.

17. The system as in claim 14, in which said threshold is variably changeable independent of the pressure in said hydraulic crimping actuator.

18. The system as in claim 14, in which said sequencing valve includes a piston disposed in a chamber in fluid communication with a hydraulic line in fluid communication with said hydraulic crimping actuator, wherein said piston slidably moves in said chamber in response to pressure in said hydraulic line to open said sequencing valve upon exceeding said threshold.

19. The system as in claim 18, including a check valve blocking the flow of hydraulic fluid out of said hydraulic tensioning actuator, and said piston acts on said check valve to allow hydraulic fluid to flow out of said hydraulic tensioning actuator upon the pressure in said hydraulic line exceeds said threshold.

20. The system as in claim 14, including a relief valve controlling the flow of hydraulic fluid into said hydraulic tensioning actuator, said relief valve being variably adjustable to open upon reaching a desired pressure corresponding to a desired tension in the cable.

* * * * *